US007118636B2

(12) United States Patent
Chen et al.

(10) Patent No.: US 7,118,636 B2
(45) Date of Patent: Oct. 10, 2006

(54) PRECIPITATION-STRENGTHENED NICKEL-IRON-CHROMIUM ALLOY

(75) Inventors: Jianqiang Chen, Greer, SC (US); Jon Conrad Schaeffer, Greenville, SC (US); Anjilivelil Kuruvilla, Greer, SC (US)

(73) Assignee: General Electric Company, Schenectady, NY (US)

( * ) Notice: Subject to any disclaimer, the term of this patent is extended or adjusted under 35 U.S.C. 154(b) by 350 days.

(21) Appl. No.: 10/249,480

(22) Filed: Apr. 14, 2003

(65) Prior Publication Data

US 2004/0202569 A1 Oct. 14, 2004

(51) Int. Cl.
*C22C 19/05* (2006.01)

(52) U.S. Cl. ..... 148/427; 148/442; 420/452; 420/453; 420/584.1; 420/586.1

(58) Field of Classification Search ..... 420/452, 420/453, 584.1, 586.1; 148/427, 442
See application file for complete search history.

(56) References Cited

U.S. PATENT DOCUMENTS

| | | | | |
|---|---|---|---|---|
| 4,853,185 | A | 8/1989 | Rothman et al. | |
| 4,981,647 | A | 1/1991 | Rothman et al. | |
| 5,019,331 | A * | 5/1991 | Yoshimoto et al. | 420/51 |
| 5,077,006 | A * | 12/1991 | Culling | 420/584.1 |
| 5,302,097 | A | 4/1994 | Brill | 420/584.1 |
| 5,328,499 | A | 7/1994 | Poole et al. | 75/255 |
| 5,695,716 | A | 12/1997 | Kohler et al. | 420/584.1 |
| 5,753,177 | A | 5/1998 | Morinaga et al. | 420/53 |
| 5,951,789 | A * | 9/1999 | Ueta et al. | 148/325 |
| 6,168,755 | B1 | 1/2001 | Biancaniello et al. | 420/57 |
| 6,261,388 | B1 | 7/2001 | Kubota et al. | |
| 6,485,679 | B1 | 11/2002 | Sundstrom et al. | 420/38 |
| 6,623,869 | B1 * | 9/2003 | Nishiyama et al. | 428/685 |

FOREIGN PATENT DOCUMENTS

EP 1234894 8/2002

OTHER PUBLICATIONS

Patent Abstracts of Japan; Nippon Steel Corp; JP 2001-131700 A; May 15, 2001.
Davis, J R; "ASM Specialty Handbook—Heat-Resistant Materials"; 1997; XP002289932; Ohio, USA; ISBN: 0-87170-596-6.

* cited by examiner

*Primary Examiner*—John P. Sheehan
(74) *Attorney, Agent, or Firm*—Ernest Cusick; Gary M. Hartman; Domenica N. S. Hartman

(57) ABSTRACT

An Fe—Ni—Cr alloy formulated to contain a strengthening phase that is able to maintain a fine grain structure during forging and high temperature processing of the alloy. The alloy contains a sufficient amount of titanium, zirconium, carbon and nitrogen so that fine titanium and zirconium carbonitride precipitates formed thereby are near their solubility limit in the alloy when molten. In the production of an article from such an alloy by thermomechanical processing, a dispersion of the fine titanium and zirconium carbonitride precipitates form during solidification of the melt and remain present during subsequent elevated processing steps to prohibit austenitic grain growth.

27 Claims, 2 Drawing Sheets

PRECIPITATION-STRENGTHENED NICKEL-IRON-CHROMIUM ALLOY

BACKGROUND OF INVENTION

1. Field of the Invention

The present invention generally relates to iron-nickel-chromium alloys. More particularly, this invention relates to an iron-nickel-chromium austenitic alloy having a composition that results in the formation of fine $(Ti_xZr_{1-x})(C_yN_{1-y})$ precipitates in an amount sufficient to play a role in grain refinement and enhance the elevated temperature strength of the alloy.

2. Description of the Related Art

Various alloys have been considered and used for shrouds, retaining rings, combustor liners, nozzles, and other high-temperature components of turbomachinery, with preferred alloys being chosen on the basis of the particular demands of the application. Shrouds, which surround the outer blade tips within the turbine section of a turbomachine, such as a gas turbine engine, require good low cycle fatigue and oxidation properties.

Many iron-nickel-chromium (Fe—Ni—Cr) austenitic alloys have been developed for turbomachinery, steel and chemical industry components, such as engine valves, heat-treating fixtures and reaction vessels. Fe—Ni—Cr alloys exhibit good oxidation and creep resistances at elevated operating temperatures, such as those within the turbine section of a turbomachine. To promote their elevated temperature properties, Fe—Ni—Cr alloys have been formulated to contain carbide and nitride-forming elements such as niobium and vanadium. Examples of such alloys include those disclosed in U.S. Pat. Nos. 4,853,185 and 4,981,647 to Rothman et al. According to Rothman et al., controlled amounts of nitrogen, niobium (columbium) and carbon are used in a defined relationship to ensure the presence of free nitrogen and carbon. Niobium is said to be required in an amount of at least nine times greater than the carbon content. Nitrogen is said to act as an interstitial solid solution strengthener and also form nitrides to provide an additional strengthening mechanism. However, strong nitride formers, such as aluminum and zirconium, are disclosed as being limited to avoid excessive initial coarse nitrides, which are said to reduce strength. Finally, the presence of niobium, vanadium or tantalum in the alloy is said to permit the presence of a very small amount of titanium (not over 0.20 weight percent) for the purpose of providing a beneficial strengthening effect. Rothman et al. teach that higher titanium contents result in the precipitation of undesirable, coarse titanium nitride particles.

Fe—Ni—Cr austenitic alloys of the type described above have found use in shroud applications. However, austenitic alloys are prone to grain growth during forging and heat-treating processes, resulting in reduced low cycle fatigue performance. Most precipitates in these alloys cannot effectively prohibit grain growth during thermomechanical processing because the precipitates are not stable at the required processing temperatures. As a result, a uniform and fine grain structure is often not achieved, especially in the production of large shroud forging rings, to the extent that an unacceptable low cycle fatigue performance results.

In view of the above, it would be desirable if an alloy were available that exhibited desirable properties for forgings intended for high temperature applications, including turbomachinery shrouds and rings.

SUMMARY OF INVENTION

The present invention provides an Fe—Ni—Cr alloy and process therefor, wherein the alloy exhibits improved low cycle fatigue resistance as well as good oxidation resistance and other elevated temperature properties. The alloy is formulated to contain a strengthening phase that is able to maintain a fine grain structure during forging and high temperature processing of the Ni—Fe—Cr alloy. According to one aspect of the invention, the strengthening phase comprises precipitates of titanium and zirconium carbonitrides $(Ti_xZr_{1-x})(C_yN_{1-y})$, and the chemical composition of the alloy is preferably such that the $(Ti_xZr_{1-x})(C_yN_{1-y})$ concentration is at or near its solubility limit in the alloy when molten. As a result, a maximum amount of fine $(Ti_xZr_{1-x})(C_yN_{1-y})$ precipitates forms during and after solidification of the alloy. According to another aspect of the invention, these precipitates are present in the alloy during and following forging and high temperature processing, such as heat treatments, during which carbide and nitride precipitates typical found in Fe—Ni—Cr alloys typically dissolve, e.g., niobium, tantalum, vanadium and chromium carbides.

An Fe—Ni—Cr austenitic alloy that achieves the above-noted desirable properties consists essentially of, by weight, about 34% to about 40% nickel, about 32% to about 38% iron, about 22% to about 28% chromium, about 0.10% to about 0.60% titanium, about 0.05% to about 0.30% zirconium, about 0.05% to about 0.30% carbon, 0.05% to about 0.30% nitrogen, about 0.05% to about 0.5% aluminum, up to 0.99% molybdenum, up to about 0.01% boron, up to about 1% silicon, up to about 1% manganese, and incidental impurities. In the production of an article from such an alloy by thermomechanical processing, a melt of the alloy is prepared to contain a sufficient amount of titanium, zirconium, carbon and nitrogen so that $(Ti_xZr_{1-x})(C_yN_{1-y})$ precipitates formed thereby are preferably near their solubility limit in the melt. Once solidified, the alloy, now containing a dispersion of fine $(Ti_xZr_{1-x})(C_yN_{1-y})$ precipitates, is thermomechanically worked, e.g., forged, followed by solution heat treating the article and quenching, producing a fine-grained article in which a dispersion of fine $(Ti_xZr_{1-x})(C_yN_{1-y})$ precipitates is still present.

In view of the above, the present invention provides an Fe—Ni—Cr austenitic alloy and process therefor, wherein the alloy exhibits desirable properties for forgings intended for high temperature applications, including turbomachinery shrouds. The alloy is not prone to grain growth during forging and heat-treating processes, as are prior art Fe—Ni—Cr alloys, as a result of the presence of the fine $(Ti_xZr_{1-x})(C_yN_{1-y})$ precipitates, which also contribute to the elevated temperature strength of the alloy. As a result, a uniform and fine grain structure can be achieved and maintained in an Fe—Ni—Cr austenitic alloy to produce a variety of components formed by thermomechanical processes, including large shroud forging rings, which as a result exhibit good low cycle fatigue performance and high temperature strength.

Other objects and advantages of this invention will be better appreciated from the following detailed description.

DETAILED DESCRIPTION

Figure 1:
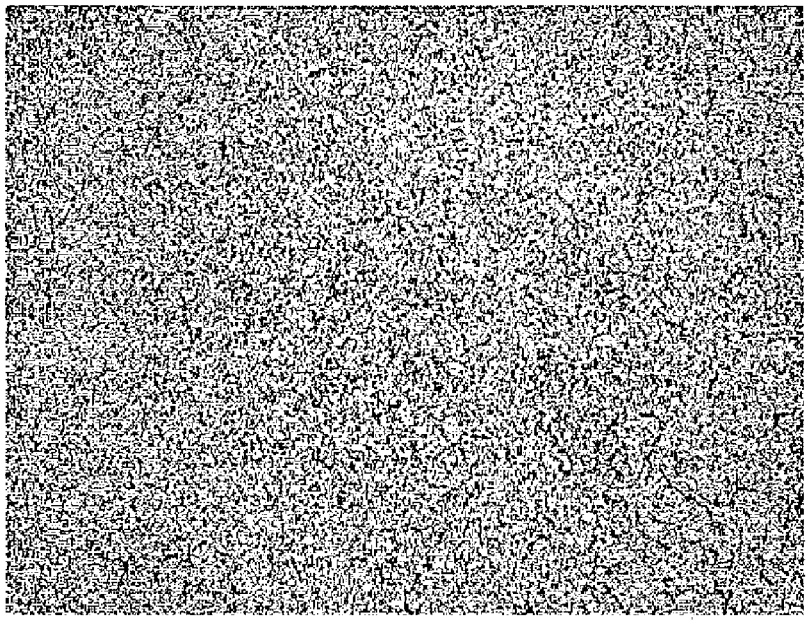
FIGS. 1 and 2 are scanned images depicting the microstructure of an Fe—Ni—Cr austenitic alloy having a composition within the scope of the present invention.

The present invention provides a precipitation-strengthened Fe—Ni—Cr alloy, and a processing method for producing articles containing the strengthening precipitates. An alloy of this invention preferably contains the following elements in the following approximate proportions based on weight percent:

| Element | Broad Range | Preferred Range | Nominal |
|---|---|---|---|
| Iron | 32.0 to 38.0 | 33.0 to 37.0 | 35.0 |
| Chromium | 22.0 to 28.0 | 23.0 to 27.0 | 25.0 |
| Titanium | 0.10 to 0.60 | 0.25 to 0.35 | 0.30 |
| Zirconium | 0.05 to 0.30 | 0.05 to 0.10 | 0.07 |
| Carbon | 0.05 to 0.30 | 0.05 to 0.15 | 0.10 |
| Nitrogen | 0.05 to 0.30 | 0.10 to 0.20 | 0.15 |
| C:N Ratio | 1:2 to 1:1 | 1:2 to <1:1 | 1:1.5 |
| Aluminum | 0.05 to 0.5 | 0.10 to 0.20 | 0.15 |
| Molybdenum | up to 0.99 | 0.60 to 0.90 | 0.75 |
| Boron | up to 0.01 | up to 0.006 | 0.005 |
| Silicon | up to 1.0 | up to 0.80 | — |
| Manganese | up to 1.0 | up to 0.80 | — |
| Nickel | Balance | Balance | Balance |

According to one aspect of this invention, the levels of titanium, zirconium, nitrogen and carbon are controlled in order to form a maximum amount of very fine $(Ti_xZr_{1-x})(C_yN_{1-y})$ precipitates in the alloy during and after solidification. Articles produced from the alloy by thermomechanical processes have a refined grain structure and improved low cycle fatigue property as a result of the fine $(Ti_xZr_{1-x})(C_yN_{1-y})$ precipitates prohibiting austenitic grain growth during forging and heat-treating processes at elevated temperatures, e.g., up to about 2250° F. (about 1230° C.).

The solubility of nitrides, such as TiN and ZrN, is extremely low in austenite, and are therefore stable during high temperature thermomechanical processing. However, only a very limited amount of fine nitride precipitates can be obtained in an Fe—Ni—Cr austenitic alloy. Simply increasing the amounts of titanium, zirconium and nitrogen in an Fe—Ni—Cr alloy leads to the formation of coarse, segregated nitride precipitates in the liquid phase of the alloy. These coarse and segregated nitrides provide little or no benefit to grain refinement, and have an adverse effect on the low cycle fatigue property of an Fe—Ni—Cr alloy. Carbide precipitation reactions, such as for TiC and ZrC, start at temperatures below the temperature range typical for thermomechanical processing of Fe—Ni—Cr alloys, e.g., about 2150° F. to about 2250° F. (about 1175° C. to about 1230° C.). Therefore, titanium and zirconium carbide precipitates do not exist during thermomechanical processing at these elevated temperatures, and therefore cannot function as grain growth inhibitors during such processes.

However, it is believed that adding a sufficient and controlled amount of carbon along with titanium, zirconium and nitrogen is capable of minimizing the precipitation of coarse nitrides and promotes the formation of fine carbonitrides in the as-cast alloy, i.e., following solidification from the melt. According to one aspect of the invention, the ratio of carbon to nitrogen (C:N) in the alloy is at least 1:2 to about 1:1, preferably less than 1:1, with a preferred ratio believed to be about 1:1.5. It is believed that this balance of carbon and nitrogen in the Fe—Ni—Cr matrix is important to obtain the desired $(Ti_xZr_{1-x})(C_yN_{1-y})$ carbonitride precipitates, instead of carbide and nitride precipitates. In contrast, as a result of the controlled amounts of nitrogen, niobium, and carbon in the alloys disclosed by U.S. Pat. Nos. 4,853,185 and 4,981,647 to Rothman et al., the precipitates present in the Rothman et al. alloys are believed to be predominantly nitrides, such as niobium nitrides (NbN), as opposed to carbonitrides. The compositions of the carbonitrides present in the alloy of the present invention are temperature dependent, with carbon content in the carbonitride precipitates decreasing with increasing temperature. It is believed that the fine $(Ti_xZr_{1-x})(C_yN_{1-y})$ precipitates present in the alloy of this invention not only play a significant role in grain refinement, but are also able to greatly improve the elevated temperature strength of the alloy. These benefits are obtained without any requirement for niobium, tantalum or vanadium to be present in the alloy, i.e., incidental levels below 0.1 weight percent, preferably below 0.05 weight percent.

To further enhance the alloy strength at elevated temperatures, e.g., in a range of about 1400° F. to about 1900° F. (about 760° C. to about 1040° C.), an appropriate amount of aluminum and, optionally, molybdenum and boron, are included in the alloy. The presence of a sufficient amount of aluminum, in combination with the titanium and zirconium levels of the alloy, is also able to avoid the formation of chromium carbides in order to maximize oxidation resistance of the alloy, achieve austenite stabilization, and avoid the formation of precipitative deleterious phases. The ranges for iron, nickel and chromium are intended to obtain the austenitic structure at temperatures above about 1000° F. (about 540° C.).

In order to achieve refined grain structure and optimized mechanical properties, it is believed that the alloy must receive adequate thermomechanical working and proper heat treatments. If forged, suitable forging process parameters include a forging temperature of about 2150° F. to about 2250° F. (about 1175° C. to about 1230° C.), at which an ingot of the alloy is upset by at least 50%, drawn to its original length, and then again upset by at least 50%. A forging produced in this manner is preferably solution heat treated at a temperature of about 2050° F. to about 2100° F. (about 1120° C. to about 1150° C.) for about one to about four hours, preferably about two hours, followed by water quenching. At the conclusion of thermomechanical processing, the alloy is capable of having an average grain size of ASTM No. 5 or finer. In the production of a forged shroud for a turbomachine, the alloy preferably has an average grain size of ASTM No. 4 or finer, more preferably ASTM No. 5 or finer.

Seven alloys having the approximate chemistries set forth in Table I below were formulated, melt, cast and forged. Multiple specimens of each alloy were cast in ingot form. Each specimen then underwent forging within a temperature range of about 2150° F. to about 2250° F. (about 1175° C. to about 1230° C.), followed by a heat treatment cycle that included a solution heat treatment at about 2100° F. (about 1150° C.) for about two hours in a vacuum, from which the specimens underwent a rapid water quench to ambient temperature. The forging operation comprised a 50% upset, drawing to original size, and a second 75% upset.

TABLE I

| | Heat No. 1 | Heat No. 2 | Heat No. 3 | Heat No. 4 | Heat No. 5 | Heat No. 6 | Heat No. 7 |
|---|---|---|---|---|---|---|---|
| Fe | 35.0 | 35.0 | 35.0 | 35.0 | 35.0 | 35.0 | 35.0 |
| Cr | 25.0 | 25.0 | 25.0 | 25.0 | 25.0 | 25.0 | 25.0 |
| Ti | 0.8 | 1.2 | 0.25 | 0.25 | 0.30 | 0.10 | 0.30 |
| Zr | 0.07 | 0.07 | 0.07 | 0.07 | 0.07 | 0.07 | 0.07 |
| C | 0.06 | 0.06 | 0.06 | 0.12 | 0.12 | 0.06 | 0.12 |
| N | 0.20 | 0.20 | 0.20 | 0.20 | 0.15 | 0.20 | 0.10 |
| C:N | 1:3.33 | 1:3.33 | 1:3.33 | 1:1.67 | 1:1.25 | 1:3.33 | 1:0.83 |
| Al | — | — | 0.15 | 0.15 | 0.15 | 0.15 | 0.15 |
| Mo | 0.75 | 0.75 | 0.75 | 0.75 | 0.75 | 0.75 | 0.75 |
| B | — | — | — | 0.006 | 0.006 | 0.006 | 0.006 |
| Ni | bal. | bal. | bal. | bal. | bal. | bal. | bal. |

The above alloying levels were selected to evaluate different levels of carbon, nitrogen, titanium and zirconium, as well as the effect of adding aluminum and boron. For example, Heats #1 and #2 differed only in their levels of titanium, and Heats #3 and #4 differed only in their levels of carbon and the boron content of Heat #4. The heats also differed in the relative amounts of carbon and nitrogen present (C:N), and as a result the relative amounts of carbon and nitrogen in the carbonitride precipitates that formed. Heats #4 and #5 had C:N ratios of between 1:2 and 1:1, while all other Heats had C:N ratios outside this range.

Figure 4:
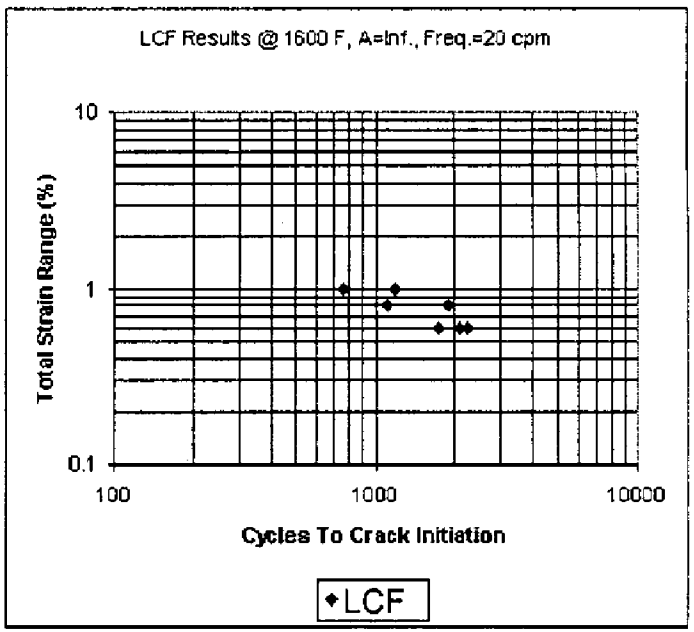
FIGS. 3 and 4 are graphs plotting the tensile strength and low cycle fatigue (LCF) properties, respectively, of seven Fe—Ni—Cr austenitic alloys having compositions within the scope of the present invention.
Figure 3:
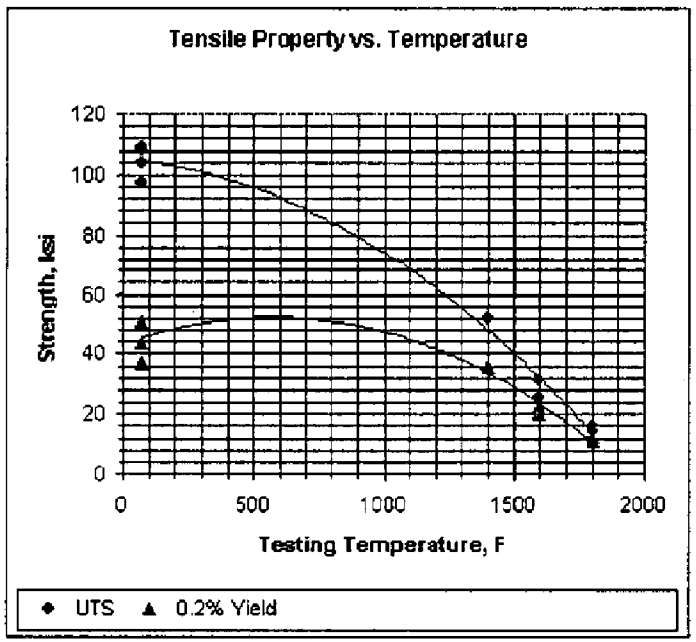

Following heat treatment, the tensile strengths of specimens from each heat were determined with standard smooth bar specimens machined from the forged specimens. Test results of specimens from the best performing alloy, Heat #4, are summarized in FIG. 3. These results indicated that this alloy exhibits improved room temperature and elevated temperature tensile strength over existing shroud materials. FIG. 4 represents the low cycle fatigue (LCF) properties of specimens formed of the alloy of Heat #4, and show that the LCF properties of the alloy are equal to or better than current shroud materials. The tensile and LCF properties of specimens formed of the alloys from both Heats #4 and #5 were found to be superior to the tensile and LCF properties of the remaining heats.

Figure 2:
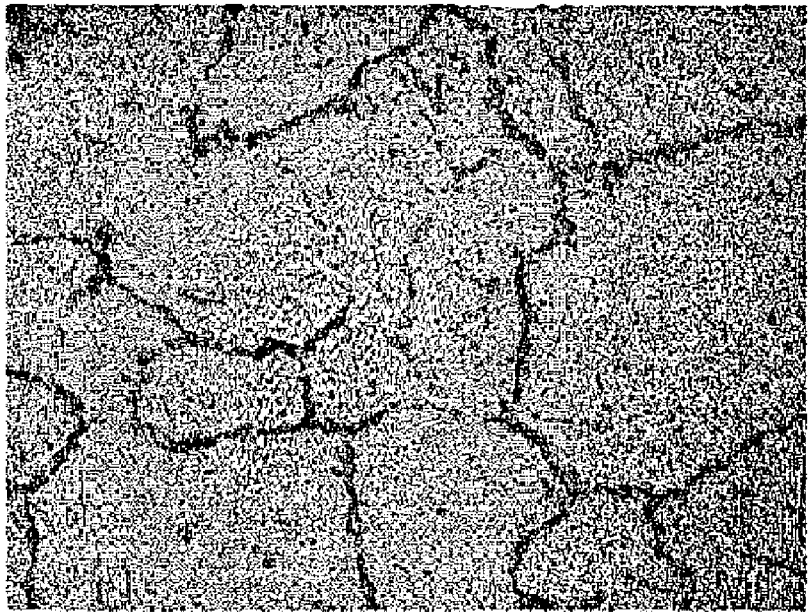

A typical microstructure for an alloy of Heat #4 that was processed in accordance with the above is depicted in FIGS. 1 and 2 (the bars in FIGS. 1 and 2 indicate distances of 200 and 20 micrometers, respectively). The refined grain structure and fine dispersion of carbonitride precipitates present after thermomechanical processing is evident from these images.

While the invention has been described in terms of a preferred embodiment, it is apparent that other forms could be adopted by one skilled in the art. Therefore, the scope of the invention is to be limited only by the following claims.

The invention claimed is:

1. A nickel-iron-chromium alloy containing, by weight, less than 0.05 niobium, at least 0.05% zirconium, at least 0.05% carbon, at least 0.05% nitrogen, a carbon:nitrogen weight ratio of at least 1:2 to less than 1:1, sufficient titanium, zirconium, and/or aluminum to be free of chromium carbides, and titanium, zirconium, carbon, and nitrogen in amounts sufficient to form a uniform dispersion of fine titanium and zirconium carbonitride $[(Ti_xZr_{1-x})(C_yN_{1-y})]$ precipitates in an amount near the solubility limit of the titanium and zirconium carbonitride precipitates in a molten state of the alloy.

2. nickel-iron-chromium alloy according to claim 1, wherein the alloy consists of, by weight, about 32% to about 38% iron, about 22% to about 28% chromium, about 0.10% to about 0.60% titanium, about 0.05% to about 0.30% zirconium, about 0.05% to about 0.30% carbon, about 0.05% to about 0.30% nitrogen, about 0.05% to about 0.5% aluminum, up to 0.99% molybdenum, up to about 0.01% boron, up to about 1% silicon, up to about 1% manganese, the balance nickel and incidental impurities.

3. The nickel-iron-chromium alloy according to claim 1, wherein the alloy contains at least 0.20 weight percent titanium.

4. The nickel-iron-chromium alloy according to claim 1, wherein the alloy contains at least 0.30 weight percent titanium.

5. The nickel-iron-chromium alloy according to claim 1, wherein the alloy contains less than 0.1 weight percent of each of tantalum and vanadium.

6. The nickel-iron-chromium alloy according to claim 1, wherein the alloy is in the form of a forging.

7. The nickel-iron-chromium alloy according to claim 1, wherein the alloy has an average grain size of about ASTM No. 5 or finer.

8. A nickel-iron-chromium alloy consisting of, by weight, about 32% to about 38% iron, about 22% to about 28% chromium, about 0.10% to about 0.60% titanium, about 0.05% to about 0.30% zirconium, about 0.05% to about 0.30% carbon, about 0.05% to about 0.30% nitrogen, about 0.05% to about 0.5% aluminum, up to 0.99% molybdenum, up to about 0.01% boron, up to about 1% silicon, up to about 1% manganese, the balance nickel and incidental impurities, wherein carbon and nitrogen are present in a carbon:nitrogen weight ratio of at least 1:2 to less than 1:1.

9. The nickel-iron-chromium alloy according to claim 8, wherein the alloy contains greater than 0.20 weight percent titanium.

10. The nickel-iron-chromium alloy according to claim 8, wherein the alloy contains at least 0.30 weight percent titanium.

11. The nickel-iron-chromium alloy according to claim 8, wherein the alloy consists of, by weight, 33% to 37% iron, 23% to 27% chromium, 0.25% to 0.35% titanium, 0.05% to 0.10% zirconium, 0.05% to 0.15% carbon, 0.10% to 0.20% nitrogen, 0.1% to 0.2% aluminum, 0.60% to 0.90% molybdenum, up to 0.006% boron, up to 0.80% silicon, up to 0.80% manganese, the balance nickel and incidental impurities.

12. The nickel-iron-chromium alloy according to claim 8, wherein the alloy consists of, by weight, about 35% iron, about 25% chromium, about 0.30% titanium, about 0.07% zirconium, about 0.10% carbon, about 0.15% nitrogen, about 0.15% aluminum, about 0.75 molybdenum, about 0.005% boron, and the balance nickel and incidental impurities, and wherein the carbon:nitrogen weight ratio is about 1:1.5.

13. The nickel-iron-chromium alloy according to claim 8, wherein the alloy contains as incidental impurities less than 0.05 weight percent of each of niobium, tantalum and vanadium.

14. The nickel-iron-chromium alloy according to claim 8, wherein the alloy contains a uniform dispersion of fine titanium and zirconium carbonitride precipitates.

15. The nickel-iron-chromium alloy according to claim 8, wherein the titanium and zirconium carbonitride precipitates are present in an amount near the solubility limit of the titanium and zirconium carbonitride precipitates in a molten state of the alloy.

16. The nickel-iron-chromium alloy according to claim 8, wherein the alloy contains sufficient titanium, zirconium, and/or aluminum to be free of chromium carbides.

17. The nickel-iron-chromium alloy according to claim 8, wherein the alloy is in the form of a forging.

18. The nickel-iron-chromium alloy according to claim 17, wherein the alloy is in the form of a shroud of a gas turbine engine.

19. The nickel-iron-chromium alloy according to claim 8, wherein the alloy has an average grain size of about ASTM No. 5 or finer.

20. A nickel-iron-chromium alloy consisting of, by weight, about 34% to about 40% nickel, about 32% to about 38% iron, about 22% to about 28% chromium, about 0.10% to about 0.60% titanium, about 0.05% to about 0.30% zirconium, about 0.05% to about 0.30% carbon, about 0.05% to about 0.30% nitrogen, about 0.05% to about 0.5% aluminum, up to 0.99% molybdenum, up to about 0.01% boron, up to about 1% silicon, up to about 1% manganese, less than 0.05 weight percent of each of niobium, tantalum and vanadium, and incidental impurities, the alloy having a carbon:nitrogen weight ratio of at least 1:2 to less than 1:1, the alloy containing a uniform dispersion of fine titanium and zirconium carbonitride precipitates in an amount near the solubility limit of the titanium and zirconium carbonitride precipitates in a molten state of the alloy.

21. The nickel-iron-chromium alloy according to claim 20, wherein the alloy contains greater than 0.20 weight percent titanium.

22. The nickel-iron-chromium alloy according to claim 20, wherein the alloy contains at least 0.30 weight percent titanium.

23. The nickel-iron-chromium alloy according to claim 20, wherein the alloy consists of, by weight, 33% to 37% iron, 23% to 27% chromium, 0.25% to 0.35% titanium, 0.05% to 0.10% zirconium, 0.05% to 0.15% carbon, 0.10% to 0.20% nitrogen, 0.1% to 0.2% aluminum, 0.60% to 0.90% molybdenum, up to 0.006% boron, up to 0.80% silicon, up to 0.80% manganese, the balance nickel and incidental impurities.

24. The nickel-iron-chromium alloy according to claim 20, wherein the alloy consists of, by weight, about 35% iron, about 25% chromium, about 0.30% titanium, about 0.07% zirconium, about 0.10% carbon, about 0.15% nitrogen, about 0.15% aluminum, about 0.75% molybdenum, about 0.005% boron, and the balance nickel and incidental impurities, and wherein the carbon:nitrogen weight ratio is about 1:1.5.

25. The nickel-iron-chromium alloy according to claim 20, wherein the alloy is in the form of a forging.

26. The nickel-iron-chromium alloy according to claim 25, wherein the alloy is in the form of a shroud of a gas turbine engine.

27. The nickel-iron-chromium alloy according to claim 20, wherein the alloy has an average grain size of about ASTM 5 or finer.

* * * * *